United States Patent [19]

Kwant et al.

[11] 4,400,264

[45] Aug. 23, 1983

[54] PROCESS FOR THE PREPARATION OF HYDROCARBON OIL DISTILLATES

[75] Inventors: Pieter B. Kwant; John R. Newsome, both of Amsterdam, Netherlands

[73] Assignee: Shell Oil Company, Houston, Tex.

[21] Appl. No.: 429,778

[22] Filed: Sep. 30, 1982

[30] Foreign Application Priority Data

Mar. 18, 1982 [NL] Netherlands ..... 8201119

[51] Int. Cl.[3] ..... C10G 49/00

[52] U.S. Cl. ..... 208/68; 208/61; 208/86; 208/95

[58] Field of Search ..... 208/68, 61, 86, 95

[56] References Cited

U.S. PATENT DOCUMENTS

| | | | |
|---|---|---|---|
| 3,281,350 | 10/1966 | Codet et al. | 208/80 |
| 3,775,293 | 11/1973 | Watkins | 208/61 X |
| 3,781,197 | 12/1973 | Bryson et al. | 208/89 X |
| 3,806,444 | 4/1974 | Crouch et al. | 208/68 |
| 4,017,379 | 4/1977 | Iida et al. | 208/68 |
| 4,039,429 | 8/1977 | Van Klinken et al. | 208/61 X |
| 4,062,758 | 12/1977 | Goudriaan et al. | 208/86 X |
| 4,120,778 | 10/1978 | Goudriaan et al. | 208/80 |
| 4,126,538 | 11/1978 | Goudriaan et al. | 208/92 X |
| 4,200,519 | 4/1980 | Kwant et al. | 208/92 X |
| 4,201,659 | 5/1980 | Kwant et al. | 208/73 |

*Primary Examiner*—Delbert E. Gantz
*Assistant Examiner*—G. E. Schmitkons

[57] ABSTRACT

Distillates are prepared from asphaltenes-rich feeds by a process comprising subjecting the feed to thermal cracking, and subjecting the distillation residue of the cracked product to a combination of solvent deasphalting and catalytic hydroconversion.

9 Claims, 4 Drawing Figures

PROCESS FOR THE PREPARATION OF HYDROCARBON OIL DISTILLATES

BACKGROUND OF THE INVENTION

1. Field of the Invention

The invention relates to a process for the preparation of hydrocarbon oil distillates from asphaltenes-containing hydrocarbon mixtures.

2. Description of the Prior Art

In the atmospheric distillation of crude mineral oil for the preparation of light hydrocarbon oil distillates, such as gasoline, kerosene and gas oil, an asphaltenes-containing residue is formed as a by-product. In the beginning these atmospheric residues (which in addition to asphaltenes, usually contain a considerable percentage of sulfur and metals) were used as fuel oil. In view of the growing demand for light hydrocarbon oil distillates and the shrinking reserves of crude mineral oil, various treatments have already been proposed which aimed at converting atmospheric residues into light hydrocarbon oil distillates. For instance, the atmospheric residue may be subjected to thermal cracking. Further, the atmospheric residue may be separated by vacuum distillation into a vacuum distillate and a vacuum residue, the vacuum distillate may be subjected to thermal cracking or to catalytic cracking in the presence or in the absence of hydrogen and the vacuum residue to thermal cracking. Finally, the vacuum residue may be separated by solvent deasphalting into a deasphalted oil and an asphaltic bitumen, the deasphalted oil may be subjected to thermal cracking or to catalytic cracking in the presence or in the absence of hydrogen, and the asphaltic bitumen to thermal cracking. One such process to prepare light hydrocarbon distillates is disclosed in U.S. Pat. No. 4,039,429. However, these prior art processes still have ample room for improvement.

SUMMARY OF THE INVENTION

Thermal cracking (TC) refers to the process wherein a heavy feestock is converted into a product which contains less than 20%w $C_4^-$ ($C_4$ to $C_1$) hydrocarbons and from which one or more distillate fractions may be separated as the desired light product and a heavy fraction as a by-product. Thermal cracking has proved in actual practice to be a suitable treatment for the preparation of hydrocarbon oil distillates from a variety of asphaltenes-containing hydrocarbon mixtures. In the present invention we have investigated whether combining the TC treatment with pretreatment of the heavy feedstock and/or aftertreatment of the heavy fraction separated from the product of thermal cracking, and using at least part of the aftertreated heavy fraction as feed for the TC treatment, might yield a better result than employing nothing but the TC. In the assessment of the results the yield of light product is most important. Next, the qualities of the light and heavy product are of importance. In this context the quality of the light product is taken to be its suitability for processing into a valuable light fuel oil. This suitability will be greater according as the light product has, among other things, lower sulfur and olefin contents. In this context the quality of the heavy product is taken to be its suitability for use as a fuel oil component. This suitability will be greater according as the heavy product has among other things, lower metal and sulfur contents and lower viscosity and density. As pretreatments for the feed of the TC treatment and as aftertreatments for the heavy fraction of the TC product the following treatments were investigated: solvent deasphalting (DA) in which an asphaltenes-containing feed is converted into a product from which a deasphalted oil fraction and an asphaltic bitumen fraction are separated, and catalytic hydrotreatment (HT) in which an asphaltenes-containing feed is converted into a product having a reduced asphaltenes content from which can be separated one or more distillate fractions as the desired light product and a heavy fraction.

During the investigation a comparison was made between the results which can be obtained when equal quantities of an asphaltenes-containing hydrocarbon mixture are used as the starting material in the preparation of a hydrocarbon oil distillate having a given boiling range and a heavy by-product by using (a) nothing but TC,
(b) TC combined with DA,
(c) TC combined with HT, and
(d) TC combined with both DA and HT, the conditions of the various treatments being as similar as possible. In view of the quantity and quality of the hydrocarbon oil distillate and the quality of the heavy by-product to be obtained in each of the procedures, the various procedures may be arranged as follows:

| | |
|---|---|
| Quantity of hydrocarbon oil distillate | d > c > b > a |
| Quality of hydrocarbon oil distillate | c > d > a > b |
| Quality of heavy by-product | c > d > a > b |

Taking into account the considerable difference in yield of hydrocarbon oil distillates obtained using procedures (c) and (d) and the no more than slight differences between the qualities of the hydrocarbon oil distillates and the heavy by-products obtained using procedures (c) and (d), a procedure in which a combination of a TC treatment, a DA treatment and a HT is used is much preferred.

As regards the order in which the three treatments are carried out and also the feeds used for each of the three treatments, a number of embodiments may be considered. In all the embodiments the deasphalted oil fraction which is separated from the product of the DA treatment is used as the feed or a feed component for the TC treatment. Each of the embodiments may be placed in one of the following three classes:

I First, the asphaltenes-containing feed is subjected to a HT, from the product thus formed a heavy fraction is separated and subjected to a combination of a DA treatment and a TC treatment.

II First, the asphaltenes-containing feed is subjected to a DA treatment, from the product thus obtained a deasphalted oil fraction and an asphaltic bitumen fraction are separated and these are both subjected to a combination of a TC treatment and a HT.

III First, the asphaltenes-containing feed is subjected to a TC treatment, from the product thus obtained a heavy fraction is separated and subjected to a combination of a HT and a DA treatment.

The embodiments belonging to class III form the subject matter of the present patent application. The embodiments belonging to classes I and II form the subject matter of copending patent application Ser. No. 429,780, filed Sept. 30, 1983 and copending patent application Ser. No. 429,778, filed Sept. 30, 1983 respectively, both application having a common assignee.

The embodiments to which the present patent application relates may further be subdivided depending on whether the heavy fraction separated from the product of the TC treatment is used as feed or a feed component for the HT (class IIIA), or as feed or a feed component for the DA treatment (class IIIB). In the embodiment belonging to class IIIA the heavy fraction separated from the product of the HT is used as feed for the DA treatment. In the embodiments belonging to class IIIB th asphaltic bitumen fraction is used as feed for the HT and the heavy fraction separated from the product of the HT is used as a feed component for the TC treatment and/or as a feed component for the DA treatment.

The present patent application therefore relates to a process for the preparation of hydrocarbon oil distillates from asphaltenes-containing hydrocarbon mixtures in which an asphaltenes-containing hydrocarbon mixture (stream 1) is subjected to a TC treatment in which one feed or two individual feeds are converted into a product which contains less than 20%w $C_4^-$ hydrocarbons and from which one or more distillate fractions and a heavy fraction (stream 5) are separated, in which stream 5 is subjected to a combination of the following two treatments: a HT in which an asphaltenes-containing feed is converted into a product which has a reduced asphaltenes content and from which one or more distillate fractions and a heavy fraction (stream 2) are separated and a DA treatment in which an asphaltenes-containing feed is converted into a product from which a deasphalted oil fraction (stream 3) and an asphaltic bitumen fraction (stream 4) are separated, in which stream 3 is used as a feed component for the TC treatment and stream 5 is used either (1) as feed or a feed component for the HT with stream 2 being used as feed for the DA treatment, or (2) as feed or a feed component for the DA treatment with stream 4 being used as feed for the HT and stream 2 as a feed component for the TC treatment and/or as a feed component for the DA treatment.

In a particular embodiment, the present invention relates to a process for the production of hydrocarbon oil distillates from a hydrocarbon mixture feed stream containing asphaltenes, said process comprising:

(a) thermally cracking said feed stream and a deasphalted oil fraction in a thermal cracking zone into a first product stream containing less than 20 percent by weight $C_4$ to $C_1$ hydrocarbons;

(b) fractionating said first product stream into one or more light distillate fractions and a first heavy distillate fraction;

(c) catalytically hydrotreating said first heavy distillate fraction in a hydrotreating zone, therein producing a second product stream having a reduced asphaltenes content;

(d) fractionating said second product stream into one or more light distillate fractions and a second heavy distillate fraction;

(e) solvent deasphalting said second heavy distillate fraction in a deasphalting zone to obtain a deasphalted oil fraction and an asphaltic bitumen fraction; and (f) routing said deasphalted oil fraction from step (e) to said thermal cracking zone.

In an alternative embodiment, the present invention relates to a process for the production of hydrocarbon oil distillates from a hydrocarbon mixture feed stream containing asphaltenes, said process comprising:

(a) thermally cracking said feed stream and a deasphalted oil fraction in a thermal cracking zone into a first product stream containing less than 20 percent by weight $C_4$ to $C_1$ hydrocarbon;

(b) fractionating said first product stream into one or more light distillate fractions and a first heavy distillate fraction;

(c) solvent deasphalting said first heavy distillate fraction in a deasphalting zone to obtain a deasphalted oil fraction and an asphaltic bitumen fraction;

(d) routing said deasphalted oil fraction to said thermal cracking zone;

(e) catalytically hydrotreating said asphaltic bitumen fraction in a hydrotreating zone, therein producing a second product stream having a reduced asphaltenes content;

(f) fractionating said second product stream into one or more light distillate fractions and a second heavy distillate fraction; and (g) routing said second heavy distillate fraction to (i) said deasphalting zone wherein said second heavy distillate fraction is solvent deasphalted, (ii) said thermal cracking zone wherein said second heavy distillate fraction is thermally cracked, or (iii) said deasphalting zone and said thermal cracking zone.

DETAILED DESCRIPTION OF THE INVENTION

Figure 1:
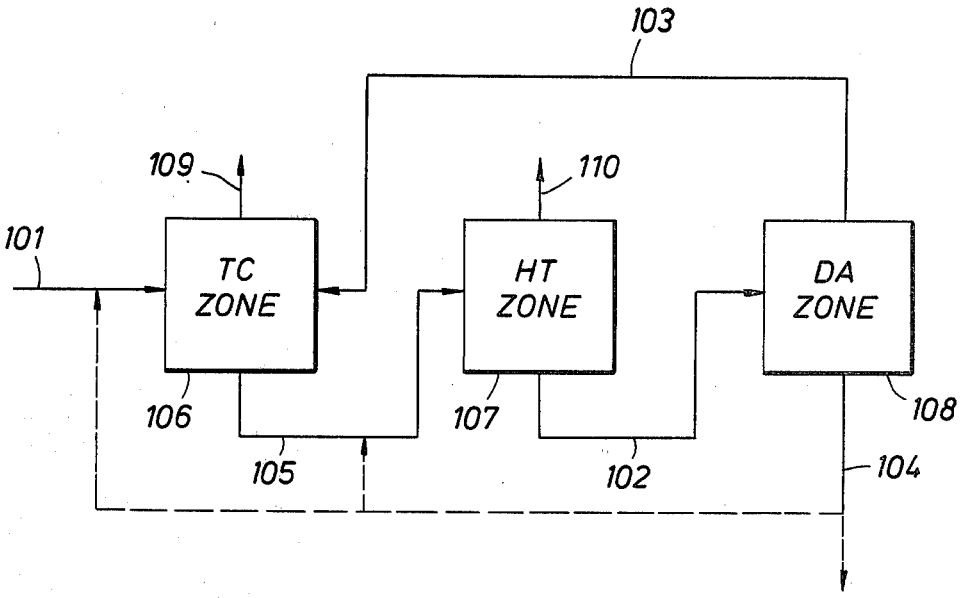
FIGS. 1–4 each illustrate different embodiments of the processing scheme according to the invention.

In the process according to the invention the feed used is an asphaltenes-containing hydrocarbon mixture. A suitable parameter for the assessment of the asphaltenes content of a hydrocarbon mixture as well as of the reduction of the asphaltenes content which appears when an asphaltenes-containing hydrocarbon mixture is subjected to a HT, is the Ramsbottom Carbon Test value (RCT). The higher the asphaltenes content of the hydrocarbon mixture, the higher the RCT. Preferably, the process is applied to hydrocarbon mixtures which boil substantially above 350° C. and more than 35%w of which boils above 520° C. and which have an RCT of more than 7.5%w. Examples of such hydrocarbon mixtures are residues obtained in the distillation of crude mineral oils and also heavy hydrocarbon mixtures obtained from shale and tar sand. If required, the process may also be applied to heavy crude mineral oils, residues obtained in the distillation of products formed in the thermal cracking of hydrocarbon mixtures and asphaltic bitumen obtained in the solvent deasphalting of asphaltenes-containing hydrocarbon mixtures. The process according to the invention can very suitably be applied to residues obtained in the vacuum distillation of atmospheric distillation residues from crude mineral oils. If an atmospheric distillation residue from a crude mineral oil is available as feed for the process according to the invention, it is preferred to separate a vacuum distillate therefrom by vacuum distillation and to subject the resulting vacuum residue to the TC treatment. The separated vacuum distillate may be subjected to thermal cracking or to catalytic cracking in the presence or in the absence of hydrogen to convert it into light hydrocarbon oil distillates. The separated vacuum distillate is very suitable for use as a feed component for the TC treatment, together with stream 3.

The process according to the invention is a three-step process in which in the first step an asphaltenes-containing feed (stream 1) is subjected to a TC treatment for the preparation of a product which contains less than 20%w $C_4-$ hydrocarbons and from which one or more distillate fractions and a heavy fraction (stream 5) are separated. In the second and third steps of the process stream 5 is subjected to a combination of a DA treatment and a HT.

In the process according to the invention the feed for the TC treatment consists of one or more streams with a relatively low asphaltenes content, such as stream 3—optionally together with one or more vacuum distillates separated off during the process—, as well as one or more relatively asphaltenes-rich streams, such as stream 1—optionally together with stream 4 and/or a stream 2 obtained as a vacuum residue. The TC treatment used should preferably include two cracking units and the two types of feed should preferably be cracked separately into products from which one or more distillate fractions and a heavy fraction (stream 5) are separated. The distillate fractions separated from the products may be nothing but atmospheric distillates, but it is preferred to separate a vacuum distillate from the products as well. The separated vacuum distillate may be converted into light hydrocarbon distillates in the ways described hereinbefore. When the TC treatment used includes two cracking units, a heavy fraction of the product from the cracking unit in which the feed with a relatively low asphaltenes content is processed, is preferably recirculated to that cracking unit. When the TC treatment used includes two cracking units, a heavy fraction with a relatively low asphaltenes content may optionally be separated from the product obtained in the cracking unit in which the relatively asphaltenes-rich feed is cracked and this heavy fraction can be used as a feed component for the cracking unit in which the feed having a relatively low asphaltenes content is processed. When the TC treatment used includes two cracking units, it is not necessary to carry out the distillation of the cracked products (atmospheric distillation and vacuum distillation, if required) in separate distillation units. If desired, the cracked products or fractions thereof may be combined and distilled together.

The TC treatment of feeds both with a relatively low and a relatively high asphaltenes content is preferably carried out at a temperature of from 400°-525° C. and a space velocity of from 0.01-5 kg fresh feed per liter cracking reactor volume per minute.

In the process according to the invention the second or third step used is a HT in which an asphaltenes-containing feed is converted into a product which has a reduced asphaltenes content and from which one or more distillate fractions and a heavy fraction (stream 2) are separated.

Asphaltenes-containing hydrocarbon mixtures usually include a considerable percentage of metals, particularly vanadium and nickel. When such hydrocarbon mixtures are subjected to a catalytic treatment, for instance a HT for the reduction of the asphaltenes content, as is the case in the process according to the invention, these metals are deposited on the catalyst used in the HT and thus shorten its effective life. In view of this asphaltenes-containing hydrocarbon mixtures having a vanadium + nickel content of more than 50 ppmw (parts per million by weight) should preferably be subjected to a demetallization treatment before they are contacted with the catalyst used in the HT. This demetallization may very suitably be carried out by contacting the asphaltenes-containing hydrocarbon mixture, in the presence of hydrogen, with a catalyst consisting more than 80%w of silica. Both catalysts consisting completely of silica and catalysts containing one or more metals having hydrogenating activity—in particular a combination of nickel and vanadium—emplaced on a carrier substantially consisting of silica, are suitable for the purpose. When in the process according to the invention an asphaltenes-containing feed is subjected to a catalytic demetallization treatment in the presence of hydrogen, this demetallization may be carried out in a separate reactor. Since the catalytic demetallization and the HT for the reduction of the asphaltenes content can be carried out under the same conditions, the two processes may very suitably be carried out in the same reactor containing a bed of the demetallization catalyst and a bed of the catalyst used in the HT, successively.

Suitable catalysts for carrying out the HT are those containing at least one metal selected from the group consisting of nickel, cobalt and mixtures thereof and in addition at least one metal selected from the group consisting of molybdenum, tungsten and mixtures thereof on a carrier, which carrier consists more than 40%w of alumina. Catalysts very suitable for use in the HT are those comprising the metal combinations nickel/molybdenum or cobalt/molybdenum or alumina as the carrier. The HT is preferably carried out at a temperature of from 300°-500° C. and in particular of from 350°-450° C., a pressure of from 50-300 bar and in particular of from 75-200 bar, a space velocity of from 0.02-10 $g \cdot g^{-1} \cdot h^{-1}$ and in particular of from 0.1-2 $g \cdot g^{-1} \cdot h^{-1}$ and a $H_2$/feed ratio of from 100-5000 $Nl \cdot kg^{-1}$ and in particular of from 500-2000 $Nl \cdot kg^{-1}$. As used herein "g" refers to grams, "h" refers to hours, "Nl" refers to normal liters and "kg" refers to kilograms. The conditions used in a catalytic demetallization treatment in the presence of hydrogen, to be carried out if required, are subject to the same preference as those for the HT for the reduction of the asphaltenes content stated hereinbefore.

The HT is preferably carried out in such a way that it yields a product the $C_5+$ fraction of which meets the following requirements:

(a) the RCT of the $C_5+$ fraction amounts to 20-70% of the feed RCT, and (b) the difference between the percentages by weight of hydrocarbon boiling below 350° C. present in the $C_5+$ fraction and in the feed is at most 40.

It should be noted that in the catalytic demetallization, apart from reduction of the metal content, there will be some reduction of the RCT and some formation of $C_5-350°$ C. product. A similar phenomenon is seen in the HT, in which, apart from reduction of the RCT and formation of $C_5-350°$ C. product, there will be some reduction of the metal content. The requirements mentioned under (a) and (b) refer to the total RCT reduction and the total formation of $C_5-350°$ C. product (viz, including those occurring in a catalytic demetallization treatment that may be carried out).

The HT yields a product having a reduced asphaltenes content from which one or more distillate fractions and a heavy fraction (stream 2) are separated. The distillate fractions separated from the product may be atmospheric distillates only, but it is preferred to separate a vacuum distillate from the product as well. This vacuum distillate may be converted into light hydrocarbon oil distillates in the ways stated hereinbefore.

In the process according to the invention the second or third step used is a DA treatment in which an asphaltenes-containing feed is converted into a product from which a deasphalted oil fraction (stream 3) and an asphaltic bitumen fraction (stream 4) are separated. Suitable solvents for carrying out the DA are paraffinic hydrocarbons having of from 3–6 hydrocarbon atoms per molecule, such as n-butane and mixtures thereof, such as mixtures of propane and n-butane and mixtures of n-butane and n-pentane. Suitable solvent/oil weight ratios lie between 7:1 and 1:1 and in particular between 4:1 and 1:1. The DA treatment is preferably carried out at a pressure in the range of from 20 to 100 bar. When n-butane is used as the solvent, the deasphalting is preferably carried out at a pressure of from 35–45 bar and a temperature of from 100°–150° C.

As has been observed hereinbefore, the embodiments to which the present patent application relates and which fall within class III may be subdivided depending on whether stream 5 is used as the feed or a feed component for the HT (class IIIA), or as the feed or a feed component for the DA treatment (class IIIB). In the embodiments falling within class IIIA stream 2 is used as the feed for the DA treatment. In the embodiments falling within class IIIB stream 4 is used as feed for the HT and stream 2 is used as a feed component for the TC treatment and/or as a feed component for the DA treatment.

DETAILED DESCRIPTION OF THE DRAWING

The various embodiments falling within class IIIA are illustrated schematically in FIG. 1. According to the Figure the process is carried out in an arrangement comprising a TC zone (106), a HT zone (107) and a DA zone (108), successively. An asphaltenes-containing hydrocarbon mixture (101) is subjected to a TC treatment and the cracked product is separated into one or more distillate fractions (109) and a residual fraction (105). Stream 5 is subjected to a HT and the hydrotreated product is separated into one or more distillate fractions (110) and a residual fraction (102). Stream 2 is subjected to a DA treatment and the product is separated into a deasphalted oil (103) and an asphaltic bitumen (104). Stream 3 is used as a feed component for the TC treatment. In addition to this embodiment (IIIA1), in which stream 4 is not subjected to further processing, FIG. 1 includes the following three embodiments:

IIIA2: The use of at least part of stream 4 as a feed component for the TC treatment.

IIIA3: The use of at least part of stream 4 as a feed component for the HT.

IIIA4: The use of part of stream 4 as a feed component for the TC treatment and as a feed component for the HT.

Figure 2:
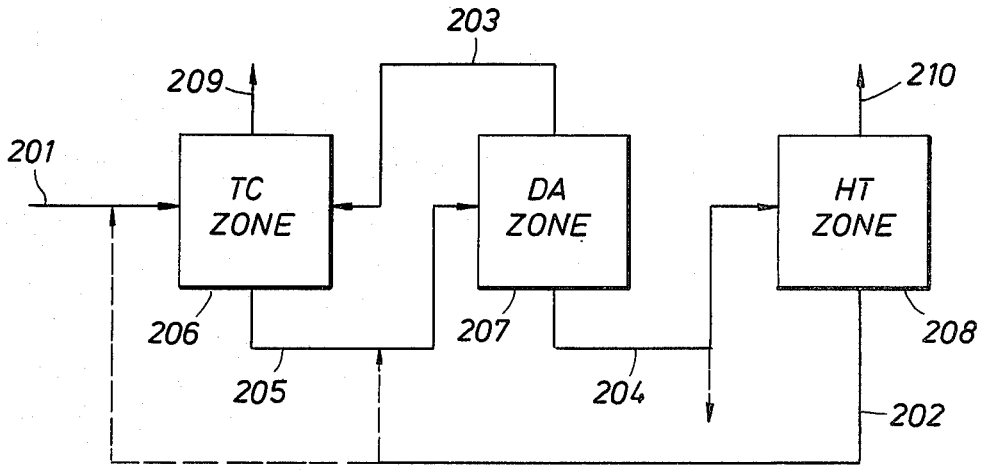

The various embodiments falling within class IIIB are represented schematically in FIG. 2. According to this Figure the process is carried out in an apparatus comprising a TC zone (206), a DA zone (207) and a HT zone (208), successively. An asphaltenes-containing hydrocarbon mixture (201) is subjected to a TC treatment and the cracked product is separated into one or more distillate fractions (209) and a residual fraction (205). Stream 5 is subjected to a DA treatment and the product is separated into a deasphalted oil (203) and an asphaltic bitumen (204). Stream 4 is subjected to a HT and the hydrogenated product is separated into one or more distillate fractions (210) and a residual fraction (202). Stream 3 is used as a feed component for the TC treatment. Stream 2 is used either as a feed component for the TC treatment (embodiment IIIB1), or as a feed component for the DA treatment (embodiment IIIB2), or as a feed component both for the TC treatment and for the DA treatment (embodiment IIIB3).

In the embodiments where it is the object to achieve the most complete conversion possible of stream (201) into hydrocarbon oil distillates, a so called "bleed stream" should preferably be separated from one of the heavy streams of the process. In this way the build-up of undesirable heavy components during the process can be achieved.

Three flow diagrams for the preparation of hydrocarbon oil distillates from asphaltenes-containing hydrocarbon mixtures according to the invention will hereinafter be explained in more detail with the aid of FIGS. 3 and 4.

FLOW DIAGRAM A (BASED ON EMBODIMENT IIIA2)

Figure 3:
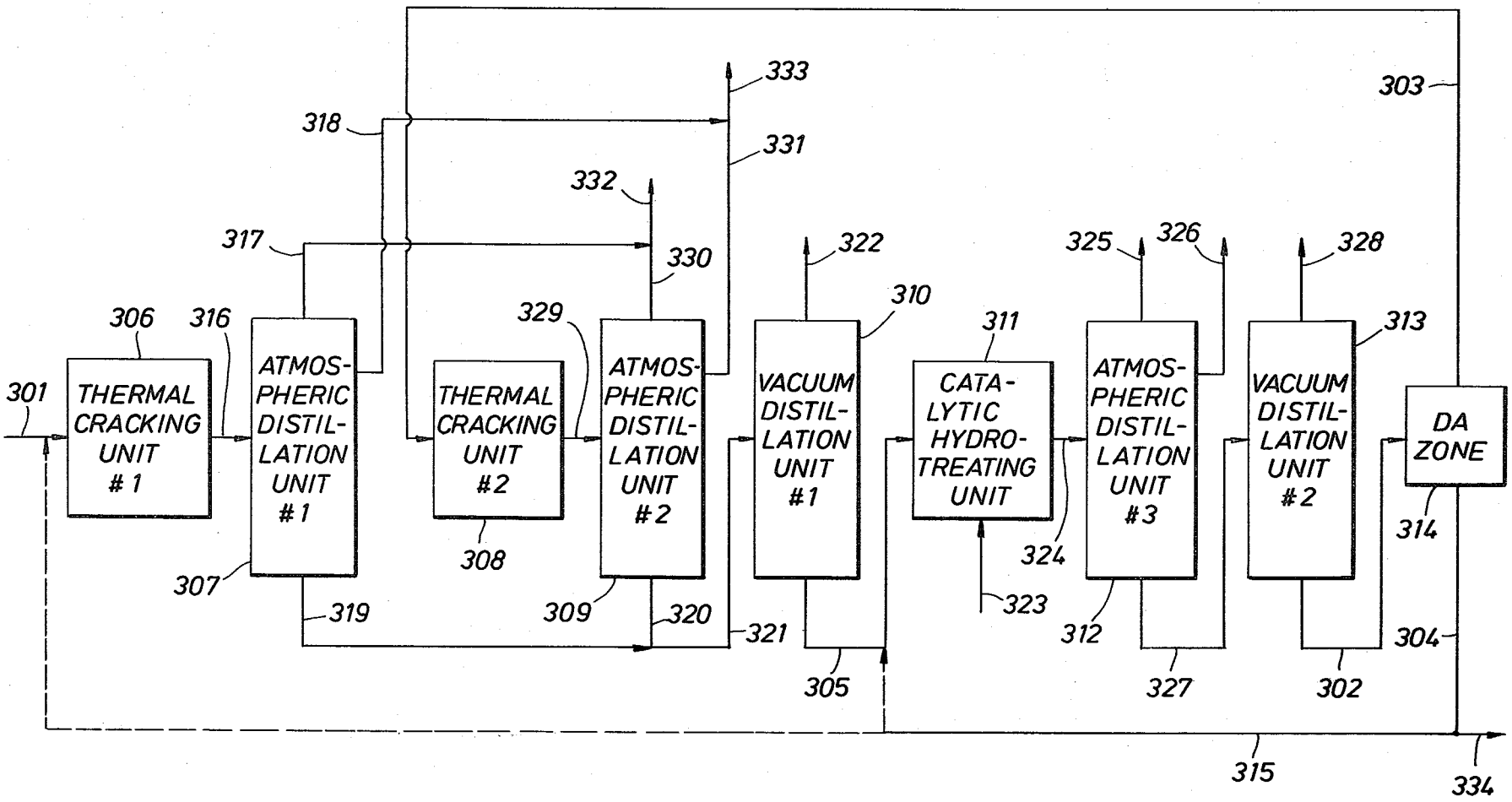

See FIG. 3.

The process is carried out in an apparatus comprising, successively, a TC zone composed of a thermal cracking unit (306), an atmospheric distillation unit (307), a second thermal cracking unit (308), a second atmospheric distillation unit (309) and a vacuum distillation unit (310), a HT zone composed of a unit for catalytic hydrotreatment (311), a third atmospheric distillation unit (312) and a second vacuum distillation unit (313) and a DA zone (314). An asphaltenes-containing hydrocarbon mixture (301) is mixed with a stream of asphaltic bitumen (315) and the mixture is subjected to thermal cracking. The thermally cracked product (316) is separated by atmospheric distillation into a gas fraction (317), an atmospheric distillate (318) and an atmospheric residue (319). The atmospheric residue (319) is mixed with an atmospheric residue (320) and the mixture (321) is separated by vacuum distillation into a vacuum distllate (322) and a vacuum residue (305). The vacuum residue (305) is subjected together with hydrogen (323) to a catalytic hydrotreatment. The hydrotreated product (324) is separated by atmospheric distillation into a gas fraction (325), an atmospheric distillate (326) and an atmospheric residue (327). The atmospheric residue (327) is separated by vacuum distillation into a vacuum distillate (328) and a vacuum residue (302). The vacuum residue (302) is separated by solvent deasphalting into a deasphalted oil (303) and an asphaltic bitumen (304). The deasphalted oil (303) is subjected to thermal cracking. The thermally cracked product (329) is separated by atmospheric distillation into a gas fraction (330), an atmospheric distillate (331) and an atmospheric residue (320). Gas fractions (317) and (330) are combined to form mixture (332). Atmospheric distillates (318) and (331) are combined to form mixture (333). Asphaltic bitumen (304) is divided into two portions (315) and (334).

PROCESS DIAGRAM B (BASED ON EMBODIMENT IIIA3)

See FIG. 3.

The process is carried out in the same apparatus and in substantially the same way as described under flow diagram A, on the understanding that in the present case the stream of asphaltic bitumen (315) is mixed with stream 5 instead of stream 1.

PROCESS DIAGRAM C (BASED ON EMBODIMENT IIIB2)

Figure 4:
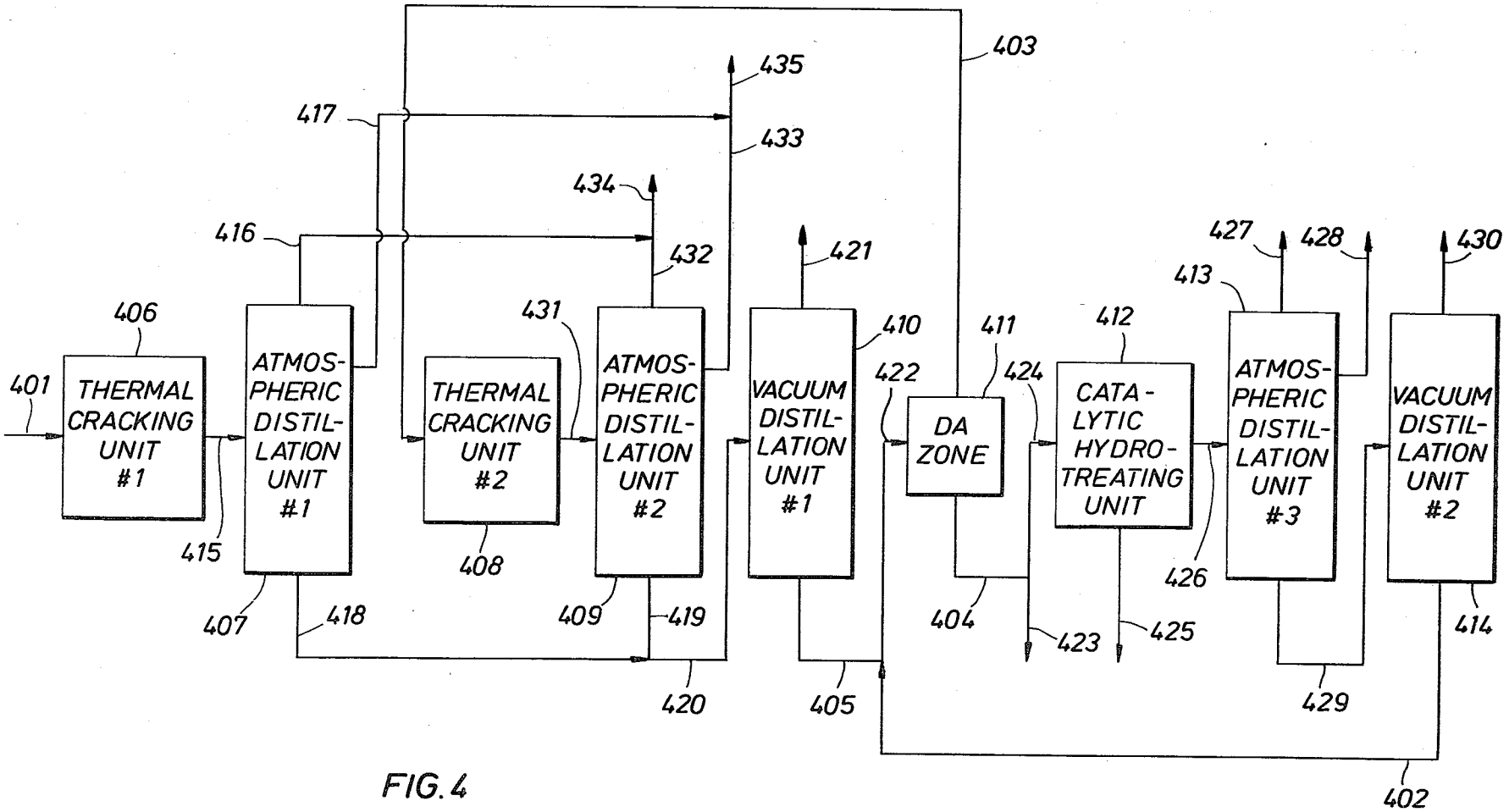

See FIG. 4.

The process is carried out in an apparatus comprising, successively, a TC zone composed of a thermal cracking unit (406), an atmospheric distillation unit (407), a second thermal cracking unit (408), a second atmospheric distillation unit (409) and a vacuum distillation unit (410), a DA zone (411) and a HT zone composed of a unit for catalytic hydrotreatment (412), a third atmospheric distillation unit (413) and a second vacuum distillation unit (414). An asphaltenes-containing hydrocarbon mixture (401) is subjected to thermal cracking and the thermally cracked product (415) is separated by atmospheric distillation into a gas fraction (416), an atmospheric distillate (417) and an atmospheric residue (418). Atmospheric residue (418) is mixed with an atmospheric residue (419) and the mixture (420) is separated by vacuum distillation into a vacuum distillate (421) and a vacuum residue (405). Vacuum residue (405) is mixed with a vacuum residue (402) and the mixture (422) is separated by solvent deasphalting into a deasphalted oil (403) and an asphaltic bitumen (404). Asphaltic bitumen (404) is divided into two portions (423) and (424). Portion (424) is subjected together with hydrogen (425) to a catalytic hydrotreatment. The hydrotreated product (426) is separated by atmospheric distillation into a gas fraction (427), an atmospheric distillate (428) and an atmospheric residue (429). The atmospheric residue (429) is separated by vacuum distillation into a vacuum distillate (430) and a vacuum residue (402). The deasphalted oil (403) is subjected to thermal cracking. The thermally cracked product (431) is separated by atmospheric distillation into a gas fraction (432), an atmospheric distillate (433) and atmospheric residue (419). Gas fractions (416) and (432) are combined to form mixture (434). Atmospheric distillates (417) and (433) are combined to form mixture (435).

The present patent application also includes apparatuses for carrying out the process according to the invention substantially corresponding with those schematically represented in FIGS. 1–4.

The invention is now illustrated with the aid of the following examples, which are given for illustration only and are not meant to limit the invention to the particular reactants and conditions employed therein.

The starting mixtures used in the process according to the invention were two asphaltenes-containing hydrocarbon mixtures obtained as residues in the vacuum distillation of atmospheric distillation residues from crude mineral oils. Both vacuum residues boiled substantially above 520° C.; they had RCT's of 20.2 and 10.1%w, respectively. The process was carried out according to flow diagrams A–C. The following conditions were used in the various zones.

In all the flow diagrams the unit for catalytic hydrotreatment comprised two reactors, the first of which was filled with a $Ni/V/SiO_2$ catalyst containing 0.5 pbw (parts by weight) of nickel and 2.0 pbw of vanadium per 100 pbw of silica, and the second of which was filled with a $Co/Mo/Al_2O_3$ catalyst containing 4 pbw of cobalt and 12 pbw of molybdenum per 100 pbw of alumina the catalysts were used in a 1:4 volume ratio. The HT was carried out at a hydrogen pressure of 150 bar, a space velocity, measured for both the reactors, of 0.5 kg feed per liter catalyst per hour, $H_2$/feed ratio of 1000 Nl per kg and an average temperature of 410° C. in the first reactor and 385° C. in the second reactor.

In all the flow diagrams the DA treatment was carried out using n-butane as solvent, at a temperature of 115° C., a pressure of 40 bar and a solvent/oil weight ratio of 3:1.

In all the flow diagrams the TC treatment was carried out in two cracking coils at a pressure of 20 bar, a space velocity of 0.4 kg fresh feed per liter cracking coil volume per minute and a temperature of 480° C. in the first cracking coil and 495° C. in the second cracking coil (temperatures measured at the outlets of the cracking coils).

EXAMPLE 1

This example was carried out according to process diagram A as represented in FIG. 3.

100 pbw vacuum residue (301) having an RCT of 20.2%w yielded the various streams in the following quantities:

- 118.0 pbw mixture of streams (301) and (315), which mixture had an RCT of 23.5%w,
- 93.6 pbw 350° C.+ atmospheric residue (319),
- 102.8 pbw mixture (321),
- 19.5 pbw 350°–520° C. vacuum distillate (322),
- 83.3 pbw 520° C.+ vacuum residue (305) having an RCT of 30.8%w,
- a product (324) the $C_5$+ fraction of which had an RCT of 15.4%w,
- 12.7 pbw $C_5$—350° C. atmospheric distillate (326),
- 68.8 pbw 350° C.+ atmospheric residue (327),
- 22.2 pbw 350°–520° C. vacuum distillate (328),
- 46.6 pbw 520° C.+ vacuum residue (302),
- 18.6 pbw deasphalted oil (303),
- 28.0 pbw asphaltic bitumen (304),
- 25.4 pbw $C_5$—350° C. atmospheric distillate (333),
- 9.2 pbw 350° C.+ atmospheric residue (320),
- 18.0 pbw portion (315), and
- 10.0 pbw portion (334).

EXAMPLE 2

This example was carried out according to process diagram B as represented in FIG. 3.

100 pbw vacuum residue (301) having an RCT of 20.2%w yielded the various streams in the following quantities:

- 82.2 pbw 350° C.+ atmospheric residue (319),
- 98.9 pbw mixture (321),
- 18.4 pbw 350°–520° C. vacuum distillate (322),
- 80.5 pbw 520° C. vacuum residue (305),
- 101.0 pbw mixture of streams (305) and (315), which mixture had an RCT of 31.2%w,
- a product (324) the $C_5$+ fraction of which had an RCT of 15.6%w,
- 16.8 pbw $C_5$—350° C. atmospheric distillate (326),
- 78.2 pbw 350° C.+ atmospheric residue (327),
- 25.5 pbw 350°–520° C. vacuum distillate (328),
- 52.7 pbw 520° C. vacuum residue (302),
- 26.9 pbw deasphalted oil (303),
- 25.8 pbw asphaltic bitumen (304),
- 24.7 pbw $C_5$—350° C. atmospheric distillate (333),
- 16.7 pbw 350° C.+ atmospheric residue (320),
- 20.5 pbw portion (315), and
- 5.3 pbw portion (334).

EXAMPLE 3

This example was carried out according to flow diagram C as represented in FIG. 4.

100 pbw vacuum residue (401) having an RCT of 10.1%w yielded the various streams in the following quantities:

81.7 pbw 350° C.+ atmospheric residue (418),
124.3 pbw mixture (420),
28.9 pbw 350°-520° C. vacuum distillate (421),
95.4 pbw 520° C.+ vacuum residue (405),
118.2 pbw mixture (422),
68.6 pbw deasphalted oil (403),
49.6 pbw asphaltic bitumen (404),
8.2 pbw portion (423),
41.4 pbw portion (424) having an RCT of 38.6%w,
a product (426) the $C_5$+ fraction of which had an RCT of 21.2%w,
5.9 pbw $C_5$−350° C. atmospheric distillate (428),
30.9 pbw 350° C.+ atmospheric residue (429),
8.1 pbw 350°-520° C. vacuum distillate (430),
22.8 pbw 520° C.+ vacuum residue (402),
39.1 pbw $C_5$−350° C. atmospheric distillate (435), and
42.6 pbw 350° C.+ atmosphere residue (419).

What is claimed is:

1. A process for the production of hydrocarbon oil distillates from a hydrocarbon mixture feed stream containing asphaltenes, said process comprising:

(a) thermally cracking said feed stream and a deasphalted oil fraction in a thermal cracking zone into a first product stream containing less than 20 percent by weight $C_4$ to $C_1$ hydrocarbons;
(b) fractionating said first product stream into one or more light distillate fractions and a first heavy distillate fraction;
(c) catalytically hydrotreating said first heavy distillate fraction in a hydrotreating zone, therein producing a second product stream having a reduced asphaltenes content;
(d) fractionating said second product stream into one or more light distillate fractions and a second heavy distillate fraction;
(e) solvent deasphalting said second heavy distillate fraction in a deasphalting zone to obtain a deasphalted oil fraction and an asphaltic bitumen fraction; and
(f) routing said deasphalted oil fraction from step (e) to said thermal cracking zone.

2. A process for the production of hydrocarbon oil distillates from a hydrocarbon mixture feed stream containing asphaltenes, said process comprising:

(a) thermally cracking said feed stream and a deasphalted oil fraction in a thermal cracking zone into a first product stream containing less than 20 percent by weight $C_4$ to $C_1$ hydrocarbons;
(b) fractionating said first product stream into one or more light distillate fractions and a first heavy distillate fraction;
(c) solvent deasphalting said first heavy distillate fraction in a deasphalting zone to obtain a deasphalted oil fraction and an asphaltic bitumen fraction;
(d) routing said deasphalted oil fraction to said thermal cracking zone;
(e) catalytically hydrotreating said asphaltic bitumen fraction in a hydrotreating zone, therein producing a second product stream having a reduced asphaltenes content;
(f) fractionating said second product stream into one or more light distillate fractions and a second heavy distillate fraction; and
(g) routing said second heavy distillate fraction to
  (i) said deasphalting zone wherein said second heavy distillate fraction is solvent deasphalted,
  (ii) said thermal cracking zone wherein said second heavy distillate fraction is thermally cracked, or
  (iii) said deasphalting zone and said thermal cracking zone.

3. The process according to claim 1 or 2 wherein said feed stream is a hydrocarbon mixture which boils substantially above 350° C., more than 35 percent by weight of which boils above 520° C., and which has an RCT of more than 7.5 percent by weight.

4. The process according to claim 1 or 2 wherein said feed stream is a residue obtained in the vacuum distillation of an atmospheric distillation residue from a crude mineral oil.

5. The process according to claim 1 or 2 wherein said catalytic hydrotreating is carried out with a catalyst comprising at least one metal selected from the group consisting of nickel, cobalt and mixtures thereof and in addition, at least one metal selected from the group consisting of molybdenum, tungsten and mixtures thereof, deposited on a carrier, which carrier comprises more than 40% by weight alumina.

6. The process according to claim 5 wherein said catalyst is selected from the group consisting of nickel/molybdenum on alumina and cobalt/molybdenum on alumina.

7. The process according to claim 1 or 2 wherein said catalytic hydrotreatment is carried out at a temperature of from 350° to 450° C., a pressure of from 75 to 200 bar, a space velocity of from 0.1 to 2 $g \cdot g^{-1} \cdot hour^{-1}$ and a $H_2$/feed ratio of from 500 to 2000 $Nl \cdot kg^{-1}$.

8. The process according to claims 1 or 2 wherein said solvent deasphalting is carried out using n-butane as the solvent at a pressure of from 35 to 45 bar and a temperature of from 100° to 150° C.

9. The process according to claims 1 or 2 wherein said thermal cracking is carried out at a temperature of from 400° to 525° C. and a space velocity of from 0.01 to 5 kg feed per liter of cracking reactor volume per minute.

* * * * *